United States Patent [19]

King

[11] Patent Number: 4,873,856

[45] Date of Patent: Oct. 17, 1989

[54] KNURLING MACHINE AND THE LIKE

[75] Inventor: David E. King, Harrison, Tenn.

[73] Assignee: C & D Engineering Company, Chattanooga, Tenn.

[21] Appl. No.: 213,362

[22] Filed: Jun. 30, 1988

[51] Int. Cl.[4] ..... B21H 7/14

[52] U.S. Cl. ..... 72/121; 72/461

[58] Field of Search ..... 72/120, 121, 125, 126, 72/461, 703; 82/48

[56] References Cited

U.S. PATENT DOCUMENTS

| | | | |
|---|---|---|---|
| 1,325,173 | 12/1919 | Shirlow et al. | 82/48 |
| 2,252,130 | 8/1941 | Lamprecht et al. | 72/126 |
| 3,225,998 | 12/1965 | Bowman | 72/121 |

*Primary Examiner*—Lowell A. Larson

*Attorney, Agent, or Firm*—Alan Ruderman

[57] ABSTRACT

Apparatus for deforming the surface of a cylindrical metal portion of a workpiece at and adjacent its end includes a rotating disk having radially extending slots. Slide members having roller deforming tools rotatably journalled at one end are positioned in a respective slot with the tool disposed radially inwardly, the tools having axes of rotation parallel to the axis of rotation of the disk. A follower member is fastened to the other end of the slide member and extends outwardly from the slot beyond the circumference of the disk. The disk is mounted within an annular shell having a tapered internal cam surface varying in diameter in the axial direction. The shell is mounted for rotation with the disk but axially moveable relative to the disk. Abutment members are positioned behind the rear surface of the shell and is driven axially to force the shell to move in the axial direction to drive the followers and thus the tools radially inwardly against the surface of the workpiece which is clamped along the axis of the disk by a power driven vise. When the force applied to the abutment member is reversed springs between the disk and the shell return the shell to the initial position.

18 Claims, 2 Drawing Sheets

KNURLING MACHINE AND THE LIKE

BACKGROUND OF THE INVENTION

This invention relates to metal deforming apparatus for knurling, chamfering and similar shaping or deforming of a metal workpiece of circular cross section, and more particularly to a machine having tools which orbit about the workpiece which is held stationary, the tools being selectively moved into contact with the workpiece when so held and in addition to orbiting rotate as a result of such contact to deform the workpiece.

It is often desirable to knurl the surface of cylindrical rod or tubing adjacent at least one end thereof. Such operations have been performed by machines wherein the workpiece is rotated and the tools are held stationary. For example, such knurling operations may be performed by placing the workpiece in a lathe and mounting the knurling tool on the tool rest and moving the knurling rollers into engagement with the workpiece. Additionally, chamfering of the ends of the workpiece may be accomplished in a similar manner simultaneously with the knurling by using chamfering rollers in combination with the knurling rollers. This method, however, is quite slow. Additionally, this method is limited to workpieces that are straight and are relatively short. If a rod, for example, having a crank handle or other offset is to be knurled by said apparatus and method, the rod must first be knurled and then bent. Thus, the knurling operation, which is generally desired as a final finishing type operation, must necessarily be performed out of sequence. In some instances the subsequent bending operation mars the knurl. If the workpiece is excessively long, it may not be accommodated by the lathe, as support for the end remote from the chuck is limited. In any event, the number of parts produced is limited by the inefficiency of the operation.

SUMMARY OF THE INVENTION

Consequently, it is a primary object of the present invention to provide apparatus for rapidly knurling, chamfering and performing similar operations on a cylindrical portion of a stationary workpiece, the apparatus having tool members which orbit about the workpiece and rotate when engaged with the workpiece It is another object of the present invention to provide apparatus which may produce a knurl, chamfer or similar shaping on a plurality of workpieces in seriatim while each workpiece is held stationary, the apparatus including shaping rollers which orbit about each workpiece in seriatim and are selectively driven into surface contact therewith to deform the workpiece, the rollers being mounted for rotation on respective axes offset from the orbiting axis.

It is a further object of the present invention to provide apparatus which may produce a knurl, chamfer or similar shaping deformation on a cylindrical portion of a workpiece having at least another portion offset from the axis of the cylindrical portion, the apparatus having orbiting roller tool members which move into contact with and are removed from the cylindrical portion selectively while the workpiece is stationary.

It is a still further object of the present invention to provide a knurl, chamfer or similar shaping deformation on a cylindrical portion of a workpiece, the apparatus having orbiting roller tool members which move into contact with and are removed from the cylindrical portion selectively while the workpiece is stationary, and having means for clamping the workpiece selectively, the clamping of the workpiece and the movement of the tool members being automatically sequenced.

Accordingly, the present invention provides apparatus for producing a knurl, chamfer or other shaping deformations or a combination of such deformations on the surface of a cylindrical metal portion of a workpiece at and adjacent the end thereof, the apparatus having shaping tools in the form of rollers, such as knurls, of the desired configuration which orbit the workpiece. The workpiece is inserted into a receiver concentric with the orbiting axis and selectively secured in a stationary disposition. The rollers are thereafter gradually forcibly moved into contact with the surface of the workpiece and the friction created thereby effects rotation of the orbiting rollers against the workpiece resulting in the deformation. The roller tools are carried by slide members in radial tracks formed in a rotatably driven disk, the disk being mounted within an annular shell having a tapered internal cam surface. The annular shell is mounted for rotation with the disk but selectively moveable relatively thereto axially along the axis of rotation. The slide members also carry cam followers disposed radially outwardly relative to the roller tools and the followers are disposed for engagement by the internal cam surface of the annular shell. The shell is selectively forcibly driven axially by power drive means and as it does the cam surface gradually forcibly urges the followers and thus the slide members and the roller tools toward the workpiece surface with the roller tools forcibly engaging the workpiece.

In the preferred form of the invention the disk has an elongated driven spindle concentric therewith and the receiver into which the workpiece is inserted comprises a bore within the disk which opens onto a bore in the spindle, the workpiece acting to abut a contact member to close a circuit. When the circuit is closed a clamp is activated to close about and hold the workpiece stationary and power drive means is activated to drive the shell axially. The relationship between the contact member and the end of the workpiece closes the circuit when the workpiece is disposed at the required position for the roller tools to deform the surface of the workpiece at the required location. After a preselected time interval, the clamp and the power drive means return to the open and initial positions respectively, and the workpiece may be removed form the bore. When another workpiece is inserted into the bore the cycle begins anew.

It is estimated that the time to complete a knurling and chamfering operation on a particular workpiece is in the order of approximately 2.7 seconds, so that approximately 22 pieces per minute may be finished. This compares to approximately 10 seconds per piece or 6 pieces per minute completed utilizing the apparatus of the prior art. Moreover, as aforesaid, if the workpiece has an offset portion relative to the axis of the cylindrical portion, in the prior art the offset would have to be produced subsequent to knurling. Such out of sequence operation is avoided by the present invention.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
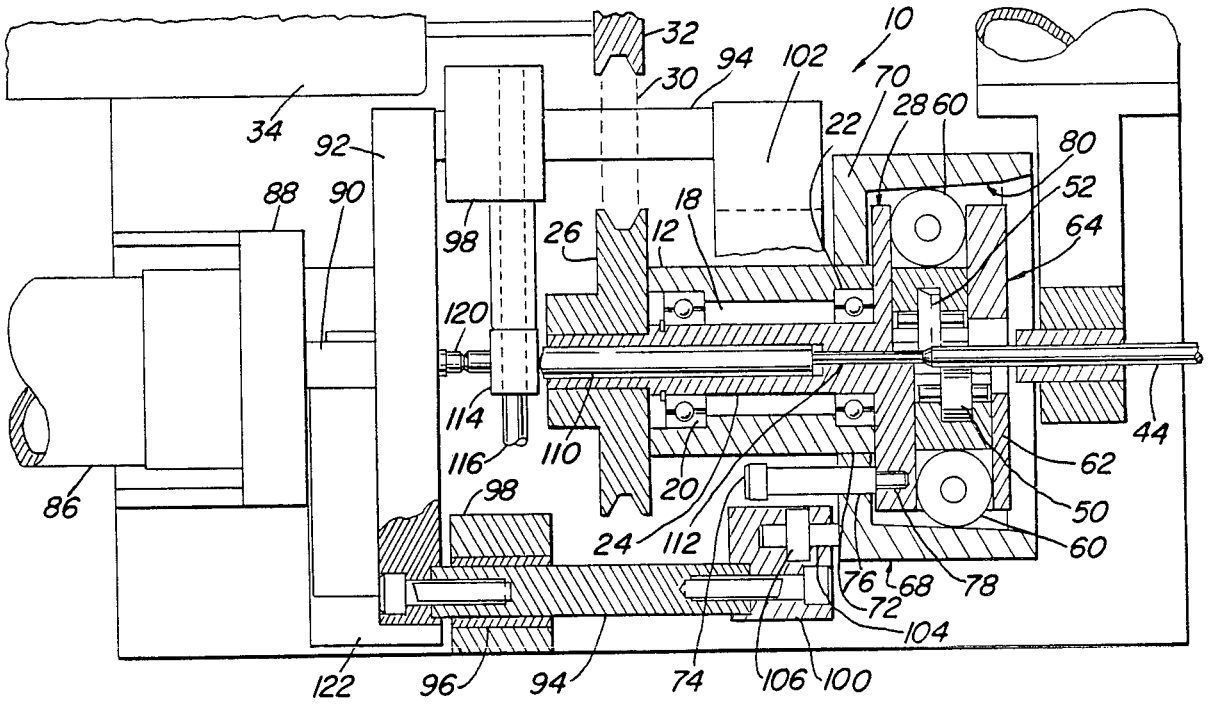
FIG. 1 is a top plan view partly in cross section of a machine incorporating apparatus constructed in accordance with the principles of the present invention, portions of the apparatus being broken away for clarity.
Figure 2:
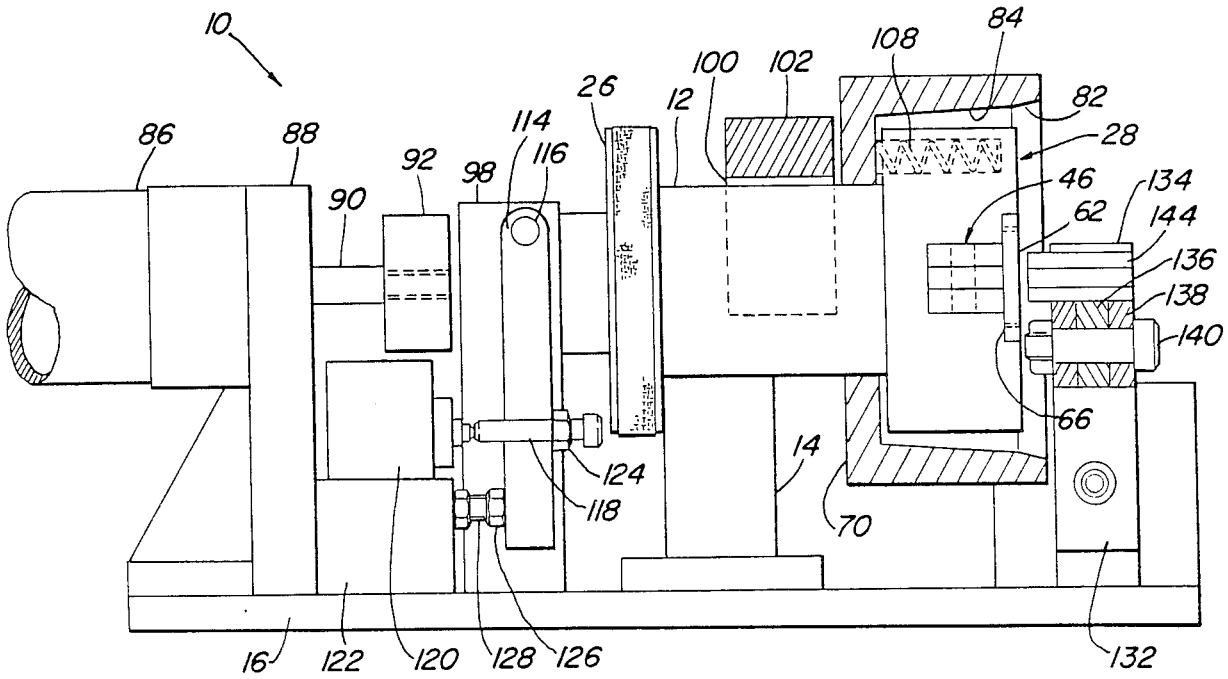
FIG. 2 is a side elevational view partly in cross section of the machine illustrated in FIG. 1.
Figure 3:
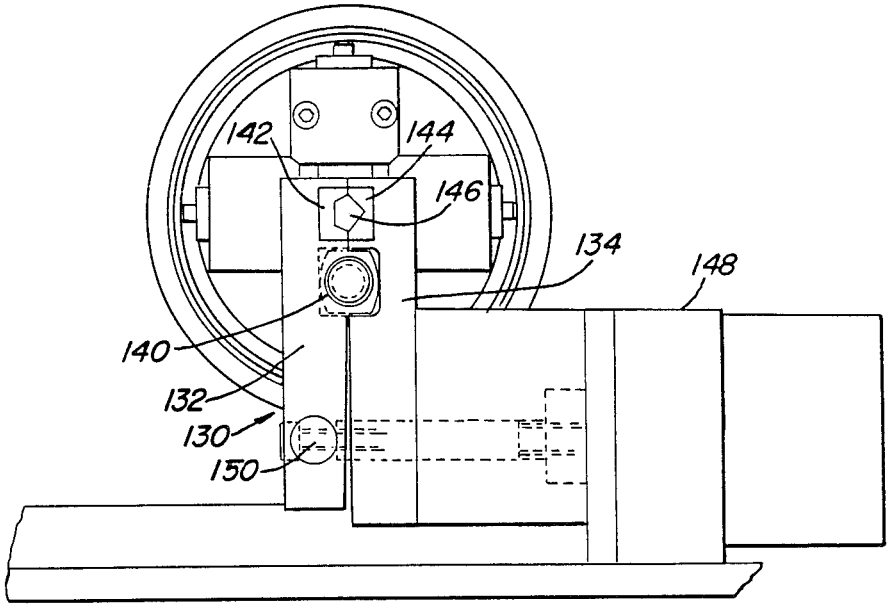
FIG. 3 is a fragmentary front end elevational view thereof.
Figure 4:
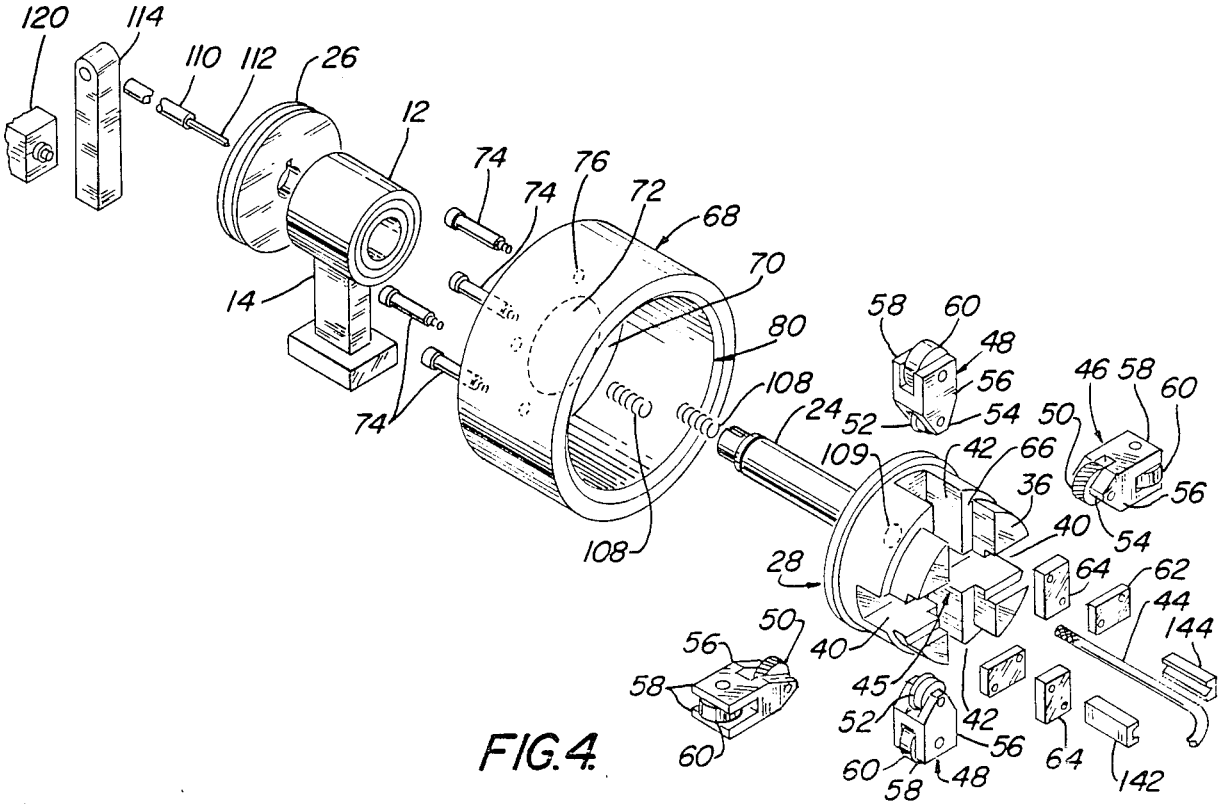
FIG. 4 is a perspective view of a portion of the apparatus incorporated in the machine.

Referring to the drawings a machine constructed in accordance with the principles of the present invention is illustrated at 10, the machine having a housing 12 secured as by welding to a pedestal 14 which is disposed on a base plate member 16. The housing 12 has a cylindrical external configuration preferably having a horizontally disposed axis and includes a cylindrical bore 18 extending concentrically therethrough. Within the bore 18 are a pair of spaced apart bearings 20, 22 which rotatably support a spindle 24. The spindle 24 extend from both ends of the housing 12 and has a pulley 26 fastened at one end, i.e., the rear end, and a disk-like member 28 secured to, and preferably integral with the other end, i.e., the front end. A continuous belt 30 is trained about the pulley 26 and about another pulley 32 mounted on the spindle of an electrical motor 34 thereby effecting rotation of the disk 28 when the motor is activated.

Formed in the face 36 of the disk 28 remote from the spindle 24 is at least one and preferably two pair of radially extending slots 40 and 42, the slots extending from the center of the disk to the periphery. For reasons which will become apparent, in the preferred embodiment each of the slots in the pair of slots 40 and 42 are diametrically opposed to each other or 180° apart so as to form a continuous diametrically extending slot, and the slots of one pair are spaced 90° from the slots in the other pair. However, the number and disposition of the slots is determined by the specific deforming operations desired to be performed on the workpiece. For example, in the preferred embodiment both a knurling and chamfering operation may be performed on the workpiece 44 by mounting knurling tools in the slots 40 and chamfering tools in the slots 42 as will hereinafter become clear, but should only one operation, such as a knurling operation, be desired only one set of slots may be required and these would be disposed at any selected angular relationship to each other. Thus, if three knurling tools and three slots were desired to be used, they may be 60° apart while if four knurling tools were used they would be 90° apart so as to balance the forces acting on the workpiece. However, in every case each slot extends from the center of the disk radially to the circumference since the disk includes a central channel 45 defined between the pairs of slots for receiving the workpiece 44. In the preferred embodiment the knurling slots 40 are spaced 90° from the chamfering slots 42 and the chamfering slots 42 are formed deeper into the face 36 of the disk 28 than are the knurling slots 40 since the chamfer is to be formed on the end of the workpiece 44 while the knurl is to be formed adjacent the chamfer.

Mounted within each slot of each pair of slots 40, 42 is a respective roller tool assembly 46, 48. Each of the assemblies 46, 48 includes a respective roller tool 50, 52, and in the preferred embodiment the roller tools 50 comprise hardened cylindrical knurl rollers having a knurl or criss-cross surface configuration and the roller tools 52 are hardened smooth cylindrical surfaces with a flare or taper extending from approximately the longitudinal center of the roller toward one end, i.e., the left end in FIG. 1, so as to deform a chamfer at the end of the workpiece 44. Each roller tool is rotatably journalled on a pin carried between the legs 54 of a bifurcated end of a slide block 56, the other end of each slide block 56 also be bifurcated but having its legs 58 offset 90° from the legs 54 for receiving a respective cylindrical roller bearing 60, the slide blocks 56 and the roller bearing 60 for each roller tool assembly being identical. The blocks 56 are slidably disposed within the respective slots 40, 42 which thus form tracks for the tool assemblies, with the roller tools 50, 52 disposed radially toward the bore 45 and inwardly of the roller bearings 60 which extend slightly outside of the respective slot and thus the periphery of the disk 28. Small retaining plates 62, 64 are secured to the face 36 of the disk 28 to retain the respective slide blocks 56 within the respective slot, the plates preferably being attached by screws to ledges 66 recesssed from the face of the disk about the slots 40, 42, but the central portion of the disk 28 radially about the area of the channel 45 is clear so that the workpiece may be inserted therein. Since the chamfer assemblies 48 are disposed deeper into the face of the disk 28 than the knurl assemblies, the retaining plates 64 are thicker than the retaining plate 62. Thus, the roller tools 50 and 52 may rotate about axes which are parallel to the axis of the disk 8, and thus the workpiece, but because of the 90° offset of the roller bearings 60 the latter members may rotate about axes offset by 90° thereto and may roll parallel to the direction in which the workpiece 44 is fed into the bore.

Disposed about the forward end of the housing 12 and about the entire disk 28 is an enlarged sleeve or shell 68 having a cylindrical external surface open at the forward end and having a wall 70 at the rear nd, the wall 70 having a central bore 72 concentric with and slightly larger than the diameter of the housing 12 so as to provide a small clearance therebetween. Four coupling/guide members in the form of shoulder screws 74 are received through respective equally spaced bores 76 formed in the rear wall 70 of the shell 68, the threaded ends of the screws being threadedly received within tapped holes 78 in the rear of the disk 28 and the heads thereof being rearwardly remote from the disk. Thus, rotation of the disk 28 rotationally drives the shell 68 by means of the screws 74, but the shell 68 may move axially along the shoulders of the screws 74 relative to the disk. The interior wall 80 of the shell forms an internal cam surface which abuts the roller bearings 60 and against which the roller bearings may roll. This annular cam surface has a varying diameter similar to an internal cone, the diameter increasing from the rear of the wall 70 toward the open front end. Thus, the surface of the wall 80 is angularly inclined relative to the axis of the shell and when the shell is moved forwardly the roller bearings 60, which function as cam followers, are forced inwardly toward the axis of the disk 28 and thus the workpiece 44, thereby forcing the roller tools 50, 52 into contact with the surface of the workpiece. In the preferred embodiment, the cam wall 80 has a leading portion 82 having a larger angle relative to the axis then the remaining portion 84 of the wall, the portion 82 being in the order of approximately 10° and the portion 84 being in the order of 3° so that the roller bearings 60 are first forced inwardly gradually rapidly and then gradually more slowly as the shell is moved forwardly thereby to first feed the roller tools 50, 52 into the workpiece rapidly and thereafter at a slower feed rate.

In order to drive the shell 68 forwardly in the axially direction power drive means in the form of a small fluid cylinder such as pneumatic cylinder 86 is provided, the cylinder housing being secured to an upstanding bracket 88 and having its piston rod 90 extending therethrough. The external end of the rod 90 is secured to a bar 92 extending laterally across the machine. Fastened at each end of the bar 92 is one end of a respective tie rod 94 which extend through and are slidably journalled in bushings 96 mounted within respective bushing support blocks 98. The other end of each tie rod 94 is fastened to a respective downwardly depending support block 100 of a bridge member 102, the bridge spanning the housing 12. Each support block 100 has a slot milled within the front face thereof for receiving a cylindrical roller 104 journalled on a pin 106 extending horizontally transversely relative to the axis of the housing 12, the rollers 104 projecting outwardly from the slot and beyond the forward face of the support block 100 so as to be adapted to abut the rear surface of the walls 70 of the shell when an electrically activated control valve such as a solenoid air valve permits pressurized air to enter the power end of the cylinder 86 to drive the piston rod 90 forwardly. When this occurs, the rollers 104 contact and drive the shell forwardly relative to the disk 28 to feed the roller tools 50, 52, by means of the roller bearings 60, inwardly against the workpiece 44. At the end of a preselected time cycle, the control valve acts to direct the air so that the piston rod 90 is returned to its original position driving the tie rods 94 and the support block 100 rearwardly to their initial positions. As the tie rods return to their initial positions the rollers 104 no longer force the shell 68 forwardly Coil springs 108 positioned within bores in the rear face of the disk 28 thereafter urge the shell rearwardly to its initial position, and centrifugal force returns the roller tools 50, 52 and the roller bearings 60 to their initial positions.

The channel 45 opens onto a bore 109 which extends entirely through the wall 70 of the disk 28 and through the spindle 24, and a push rod 110 is slidably disposed within the spindle bore, the rod having a small extension 112 projecting through the wall of the disk into the channel at a disposition where it may abut the workpiece 44 when the workpiece is at the desired location for engagement of the surface to be deformed by the roller tools 50, 52. The end of the rod 110 remote from the disk 28 is disposed for engaging a stop bar 114 pivotably mounted adjacent one end on a pin 116 having its ends secured to a respective bushing support block 98. A screw 118 is threadedly received through the stop bar 114 and has the end of its shank disposed for engaging a limit switch 120 secured to a support block 122 fastened to the base plate 16, the limit switch acting to control the cylinder 86. A nut 124 received about the screw 118 permits adjustment of the screw 118, and this together with the lever arm effect of the bar and an adjustable stop member in the form of a nut 126 on a screw 128 carried by the block 122, permits the pivotable stop bar 114 to be adjusted within precise limits so that the limit switch 120 may be actuated when the workpiece is at the desired depth within the disk 28.

Disposed at the front of the machine is a pneumatically operated vise 130 comprising a pair of arms 132, 134, one of which i.e., arm 132 has an ear 136 received within a pair of spaced lugs 138 extending from the other of the arms and pivotably connected thereto by means of a shoulder screw 140. A first vise jaw 142 is secured within a recess in the arm 132 while another vise jaw 144 is secured within a similar recess in the arm 134, both of the jaws being mounted above the pivot connection provided by the screw 140. Both jaws together form an opening 146 for receipt of the workpiece 44, the opening 142 being aligned with the channel 45 in the disk 28. The housing of a pneumatic cylinder 148 is secured to the arm 134 and the base plate 16 while an extension 150 of the piston rod of the cylinder 148 is pivotably connected to the arm 132 beneath the pivot screw 140. Thus, when the power end of the cylinder 148 is pressurized, the piston rod forces the arm 132 to pivot relative to the arm 134 to move the jaw 142 toward the jaw 144 and close about the workpiece, and when the pressure is released the jaws open.

In operation, the disk 28 is rotated when the motor 34 is activated, and rotatably drives the shell 68 by means of the shoulder screws 74. When the workpiece 44 is manually inserted into the opening 146 between the open jaws 142, 144 and into the channel 45 of the disk 28, the leading end of the workpiece contacts the end of the rod 110 which acts against the stop bar 114 to operate the electric-pneumatic circuit. The cylinder 148 is first actuated to clamp the workpiece between the vise jaws preventing the workpiece from rotating and from extracting from the disk 28. The cylinder 86 then drives the shell 68 forwardly which applies the inward thrust to the roller tools 50, 52 by means of the action of the cam surface 80, the speed at which the shell is moved being controlled by flow control valves (not illustrated) to the cylinder 86 in conventional manner, and the amount of forward movement of the shell and thus the force applied inwardly to the tools is controlled by conventional timing means. At the end of the time cycle, both cylinders 86, 148 are returned to their respective starting positions, the jaws 142, 144 open, the shell 68 is returned to its initial position by means of the springs 108, and centrifugal force returns the roller tools to their initial position permitting the workpiece to be removed and allowing another workpiece to be inserted into the machine.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for deforming a cylindrical surface of a workpiece comprising, a disk having a front face and an axial channel for receiving said workpiece secured in front of said front face, rotatable drive means for rotating said disk about an axis extending through said channel, a plurality of radial slots extending from said channel to the circumference of said disk, a slide member disposed in a respective slot so as to have a radially inward end and a radially outward end, a deforming tool in the form of a roller rotatably carried by each of said slide members at said radially inward end, each of said rollers having an axis of rotation substantially parallel to the axis of said channel, a cam follower carried by each slide member at the respective radially outward end and extending out of each respective slot, an annular shell disposed concentrically about said disk, said shell having an internal annular surface abutting said cam followers, means connecting said shell to said disk for rotation therewith and for axial movement relatively thereto, said internal surface being annularly inclined relative to said axis to define an annular cam having a varying diameter increasing from a first end toward a second end, and axial drive means for moving said shell axially relatively to said disk in the direction in which said diameter increases so that progressively smaller diameter portions of said internal surface abut said followers to move said deforming tools progressively closer toward said channel for progressively deforming said workpiece.

2. Apparatus as recited in claim 1, wherein said disk includes a spindle extending from the face of said disk opposed to said front face, a housing, means for rotatably journalling said spindle in said housing, and said rotatable drive means including means for rotating said spindle.

3. Apparatus as recited in claim 2, wherein said spindle has an axial bore extending therethrough and opening into the axial channel in said disk, a push rod disposed within the bore of said spindle and having one end within the channel of said disk for abutting said workpiece and a second end extending externally out of said spindle, and contact means for abutting said second end for initiating movement of said axial drive means.

4. Apparatus as recited in claim 2, wherein said shell includes a radially extending wall at one end thereof, said means connecting said shell to said disk comprising apertures extending through said wall substantially parallel to said axis, and coupling members secured to said disk and extending through said apertures, said coupling members and said apertures having substantially the same cross sectional configuration so that said shell may be axially guided by said coupling members.

5. Apparatus as recited in claim 4, wherein said radially extending wall includes a bore and said housing is received within said bore.

6. Apparatus as recited in claim 5, wherein said means for rotating said spindle includes a drive member fastened on said spindle, and means for rotating said drive member.

7. Apparatus as recited in claim 5, wherein said spindle has an axial bore extending therethrough and opening into the axial channel in said disk, a push rod disposed within the bore of said spindle and having one end within the channel of said disk for abutting said workpiece and a second end extending externally out of said spindle, and contact means for abutting said second end for initiating movement of said axial drive means.

8. Apparatus as recited in claim 7, wherein said means for rotating said spindle includes a drive member fastened on said spindle, and means for rotating said drive member.

9. Apparatus as recited in claim 1, wherein said shell includes a radially extending wall at one end thereof, said means connecting said shell to said disk comprising apertures extending through said wall substantially parallel to said axis, and coupling members secured to said disk and extending through said apertures, said coupling members and said apertures having substantially the same cross sectional configuration so that said shell may be axially guided by said coupling members.

10. Apparatus as recited in claim 9, wherein said axial drive means comprises a fluid actuated cylinder having a driveable piston rod, abutment means disposed outside said shell rearwardly of said radially extending wall for contacting said wall and forcing said shell in said direction when said piston rod is driven in said direction, and means for fastening said abutment means to said piston rod.

11. Apparatus as recited in claim 10, including biasing means disposed between said radially extending wall of said shell and the face of said disk opposed to said front face for urging said shell axially relative to said disk in the direction opposite to the direction said shell is moved by said axial drive means for moving said shell in said opposite direction when said piston rod is driven in said opposite direction, whereby said workpiece may be removed from said axial channel.

12. Apparatus as recited in claim 1, wherein each of said followers comprises a roller having an axis of rotation offset by 90° from the axis of rotation of the respective deforming tool for rolling along said integral surface of said shell.

13. Apparatus as recited in claim 1, including power driven vise means for clamping and precluding rotation of said workpiece when said workpiece is disposed within the channel of said disk in position for deforming by said tools.

14. Apparatus as recited in claim 13, wherein said spindle has an axial bore extending therethrough and opening into the axial channel in said disk, a push rod disposed within the bore of said spindle and having one end within the channel of said disk for abutting said workpiece and a second end extending externally out of said spindle, and contact means for abutting said second end for initiating movement of said axial drive means and for initiating clamping of said workpiece.

15. Apparatus as recited in claim 1, wherein said internal surface is inclined relative to said axis at two different inclinations, a first of said inclinations being at a smaller angle toward said axis than the second of said inclinations, the portion of said surface having said first inclination extending from said first end toward said second end and the portion of the surface having said second inclination extending from said second end toward said first end, whereby said followers and said tools are moved toward said channel more rapidly adjacent said second end than said first end.

16. A method of deforming a cylindrical surface of a workpiece, said method comprising:

(a) mounting a plurality of roller deforming tools for radial movement along the face of a disk having radial slideways, said roller tools being positioned in respective slideways and mounted for rotation about respective axes parallel to the axial center of said disk, (b) clamping said workpiece along said axial center of said disk substantially perpendicular to said face, (c) rotating said disk about an axis coincident with said axial center to orbit said tools about said axis and said surface, and (d) gradually driving said tools radially inwardly at a first rate and thereafter at a slower rate into engagement with said surface while said tools are orbiting by forcibly sliding said slide members toward said axis to rotate said tools by means of friction between said tools and said surface so as to conform said surface to that of said tools.

17. The method recited in claim 16, wherein said disk is mounted within a shell having an internal annular cam surface having a diameter varying in the axial direction and said slide members carry followers adapted to abut said internal surface, said step of driving said tools comprising moving said shell axially to contact said followers with gradually reduced diameter portions of said surface.

18. Apparatus as recited in claim 15, wherein said surface having said second inclination is substantially shorter in the direction of said axis than said surface having said first inclination.

* * * * *